US012247334B2

(12) United States Patent
Moody et al.

(10) Patent No.: US 12,247,334 B2
(45) Date of Patent: Mar. 11, 2025

(54) HIGH LOFT NONWOVEN FABRICS

(71) Applicant: Berry Global, Inc., Evansville, IN (US)

(72) Inventors: Ralph A. Moody, Mooresville, NC (US); Abhay Joijode, Huntersville, NC (US); Mehmet Selcuk Sinangil, Mooresville, NC (US)

(73) Assignee: BERRY GLOBAL, INC., Evansville, IN (US)

( * ) Notice: Subject to any disclaimer, the term of this patent is extended or adjusted under 35 U.S.C. 154(b) by 67 days.

(21) Appl. No.: 17/968,316

(22) Filed: Oct. 18, 2022

(65) Prior Publication Data

US 2023/0119301 A1 Apr. 20, 2023

Related U.S. Application Data

(60) Provisional application No. 63/256,796, filed on Oct. 18, 2021.

(51) Int. Cl.

| | |
|---|---|
| ***D04H 1/4382*** | (2012.01) |
| ***D04H 1/06*** | (2012.01) |
| ***D04H 1/4291*** | (2012.01) |
| ***D04H 3/007*** | (2012.01) |
| ***D04H 3/147*** | (2012.01) |

(52) U.S. Cl.

CPC ..... *D04H 1/43828* (2020.05); *D04H 1/06* (2013.01); *D04H 1/4291* (2013.01); *D04H 1/4383* (2020.05); *D04H 1/43832* (2020.05); *D04H 3/007* (2013.01); *D04H 3/147* (2013.01); *D10B 2321/021* (2013.01); *D10B 2321/022* (2013.01)

(58) Field of Classification Search

CPC ..... D04H 1/43828; D04H 1/43832; D04H 1/4383; D04H 1/06; D04H 1/4291; D04H 3/007; D04H 3/147; D10B 2321/021; D10B 2321/022

See application file for complete search history.

(56) References Cited

U.S. PATENT DOCUMENTS

| | | | |
|---|---|---|---|
| 6,454,989 | B1 | 9/2002 | Neely et al. |
| 2004/0013877 | A1 | 1/2004 | Nadkarni |

(Continued)

FOREIGN PATENT DOCUMENTS

| | | | |
|---|---|---|---|
| CN | 112281306 | A | 1/2021 |
| CN | 112662061 | A * | 4/2021 |

(Continued)

OTHER PUBLICATIONS

English translation of CN-112662061-A to Li et al. obtained from PE2E database (Year: 2021).*

(Continued)

*Primary Examiner* — Jeremy R Pierce

(74) *Attorney, Agent, or Firm* — BURR & FORMAN LLP

(57) ABSTRACT

Nonwoven fabrics are provided that include a plurality of crimped bicomponent fibers having a first component comprising a first polymeric material comprising a first polymer or a first polymeric blend and a second component comprising a second polymeric material, in which the second polymeric material comprises a second polymeric blend of (i) at least one polypropylene polymer, (ii) at least one polyethylene polymer, and (iii) at least one compatibilizer comprising or consisting of at least one polypropylene-polyethylene copolymer.

19 Claims, 4 Drawing Sheets

(56) References Cited

U.S. PATENT DOCUMENTS

Figure 1:
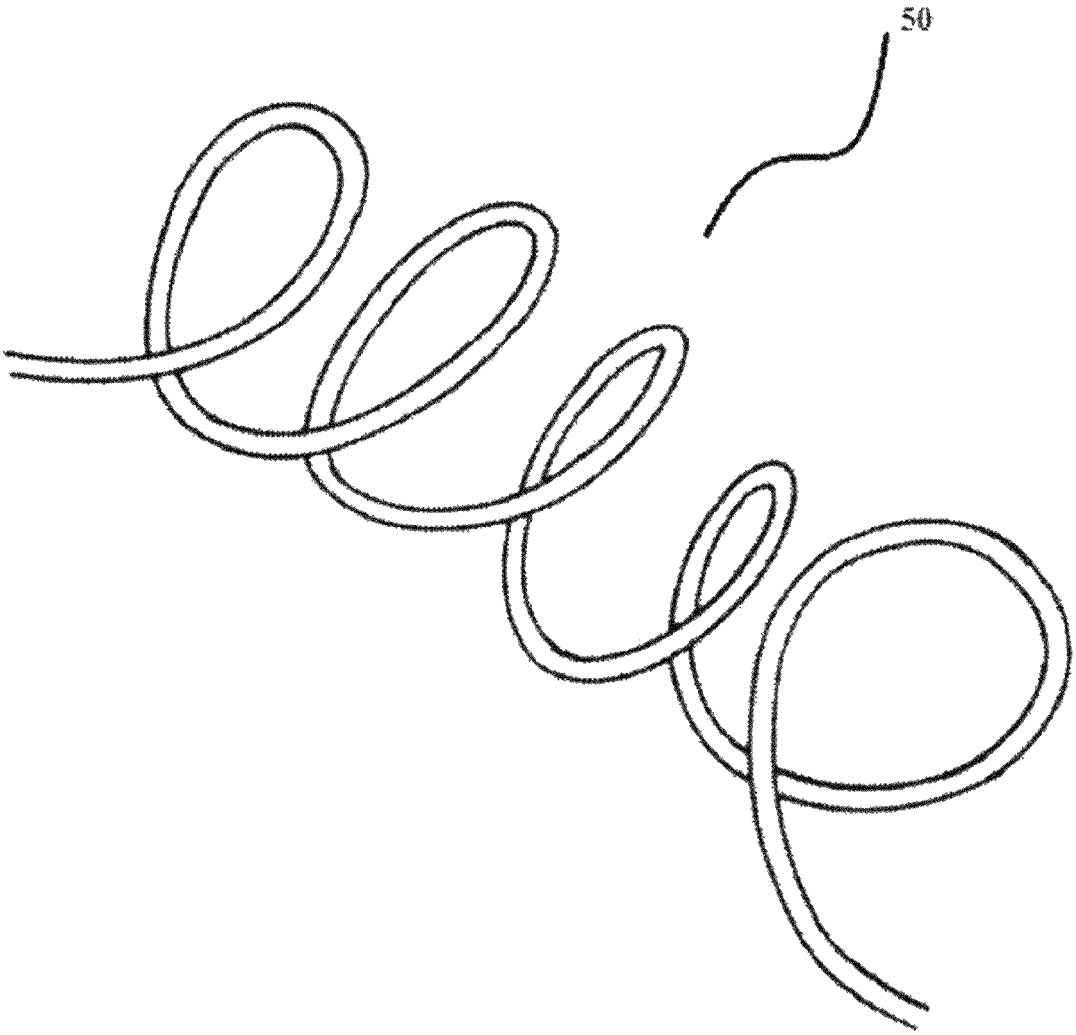

| | | | |
|---|---|---|---|
| 2007/0014987 | A1 | 1/2007 | Usui et al. |
| 2017/0335498 | A1 | 11/2017 | Hansen et al. |
| 2018/0002850 | A1 | 1/2018 | Hansen et al. |
| 2018/0355516 | A1* | 12/2018 | Stoiljkovic ..... D01F 6/46 |
| 2020/0102672 | A1 | 4/2020 | Moody et al. |

FOREIGN PATENT DOCUMENTS

| | | | |
|---|---|---|---|
| EP | 0277707 | A2 | 8/1988 |
| EP | 0685579 | A2 | 12/1995 |
| EP | 2343406 | A1 | 7/2011 |
| EP | 3121314 | A1 | 1/2017 |
| EP | 3246443 | A1 | 11/2017 |
| EP | 3521495 | A1 | 8/2019 |
| WO | 0028123 | A1 | 5/2000 |
| WO | 0146506 | A2 | 6/2001 |
| WO | 2005080497 | A1 | 9/2005 |
| WO | 2009027021 | A2 | 3/2009 |
| WO | 2017091669 | A1 | 6/2017 |
| WO | 2017198336 | A1 | 11/2017 |
| WO | 2019094978 | A1 | 5/2019 |
| WO | 2019152974 | A1 | 8/2019 |
| WO | 2020069354 | A1 | 4/2020 |

OTHER PUBLICATIONS

International Search Report and Written Opinion of International Application No. PCT/US2019/053514 mailed on Dec. 20, 2019, all enclosed pages cited.

Second Written Opinion of International Application No. PCT/US2019/053514 mailed on Sep. 8, 2020, all enclosed pages cited.

Office Action issued in corresponding Chinese Application No. 201980063539.2 on Mar. 22, 2022, all enclosed pages cited.

Second Office Action issued in corresponding Chinese Application No. 201980063539.2 on Nov. 14, 2022, all enclosed pages cited.

International Search Report and Written Opinion of International Application No. PCT/US2022/046989 mailed on Feb. 10, 2023, all enclosed pages cited.

* cited by examiner

HIGH LOFT NONWOVEN FABRICS

CROSS-REFERENCE TO RELATED APPLICATIONS

This application claims priority under 35 U.S.C. § 119(e) to U.S. Provisional Application No. 63/256,796, filed Oct. 18, 2021, which is expressly incorporated by reference herein in its entirety.

TECHNICAL FIELD

Embodiments of the presently-disclosed invention relate generally to nonwoven fabrics having a plurality of crimped bicomponent fibers having a first component comprising a first polymeric material comprising a first polymer or a first polymeric blend and a second component comprising a second polymeric material, in which the second polymeric material comprises a second polymeric blend of (i) at least one polypropylene polymer, (ii) at least one polyethylene polymer, and (iii) at least one compatibilizer comprising or consisting of at least one polypropylene-polyethylene copolymer.

BACKGROUND

In nonwoven fabrics, the fibers forming the nonwoven fabric are generally oriented in the x-y plane of the web. As such, the resulting nonwoven fabric is relatively thin and lacking in loft or significant thickness in the z-direction. Loft or thickness in a nonwoven fabric suitable for use in hygiene-related articles (e.g., personal care absorbent articles) promotes comfort (softness) to the user, surge management, and fluid distribution to adjacent components of the article. In this regard, high loft, low density nonwoven fabrics are used for a variety of end-use applications, such as in hygiene-related products (e.g., sanitary pads and napkins, disposable diapers, incontinent-care pads, etc.). High loft and low density nonwoven fabrics, for instance, may be used in products such as towels, industrial wipers, incontinence products, infant care products (e.g., diapers), absorbent feminine care products, and professional health care articles.

SUMMARY OF INVENTION

One or more embodiments of the invention may address one or more of the aforementioned problems. Certain embodiments according to the invention provide a nonwoven fabric comprising a plurality of crimped bicomponent fibers having a first component comprising a first polymeric material comprising a first polymer or a first polymeric blend and a second component comprising a second polymeric material, in which the second polymeric material comprises a second polymeric blend of (i) at least one polypropylene polymer, (ii) at least one polyethylene polymer, and (iii) at least one compatibilizer comprising or consisting of at least one polypropylene-polyethylene copolymer.

In another aspect, the present invention provides a method of making a nonwoven fabric. The method may comprise the following: (a) forming a first polymeric melt comprising a first polymer or a first polymeric blend; (b) forming a second polymeric melt including a second polymeric blend of (i) at least one polypropylene polymer, (ii) at least one polyethylene polymer, and (iii) at least one compatibilizer comprising a polypropylene-polyethylene copolymer; (c) forming a plurality of bicomponent fibers via melt-spinning the first polymeric melt and the second polymeric melt through a bicomponent spinnerette pack; (d) allowing the plurality of bicomponent fibers to crimp prior to or during laydown on a collection surface or subjecting the plurality of bicomponent fibers to a crimping operation to provide a plurality of crimped bicomponent fibers; and (e) consolidating the plurality of crimped bicomponent fibers to form a nonwoven fabric.

In another aspect, the present invention provides a method of making a nonwoven fabric. The method may comprise the following: (a) forming a first polymeric melt comprising a first polymer or a first polymeric blend; (b) forming a second polymeric melt including a second polymeric blend of (i) at least one polypropylene polymer, (ii) at least one polyethylene polymer, and (iii) at least one compatibilizer comprising a polypropylene-polyethylene copolymer; (c) forming a plurality of bicomponent fibers via melt-spinning the first polymeric melt and the second polymeric melt through a bicomponent spinneret pack; (d) consolidating the plurality of bicomponent fibers to form an intermediate nonwoven fabric; and (e) subjecting the plurality of bicomponent fibers of the intermediate nonwoven fabric to a crimping operation to provide a nonwoven fabric.

In yet another aspect, the present invention provides an article comprising one or more nonwoven fabrics as described and disclosed herein. The article may comprise an adult diaper, a baby diaper, a pull-up, of a feminine hygiene pad. In accordance with certain embodiments of the invention, the article may comprise a topsheet comprising a nonwoven fabric as described and disclosed herein.

BRIEF DESCRIPTION OF THE DRAWING(S)

The invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout, and wherein:

FIG. 1 illustrates a crimped bicomponent fiber in accordance with certain embodiments of the invention; and FIG. 2A-2H illustrate examples of cross-sectional views for some example bicomponent fibers in accordance with certain embodiments of the invention.

DETAILED DESCRIPTION

The invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The terms "substantial" or "substantially" may encompass the whole amount as specified, according to certain embodiments of the invention, or largely but not the whole amount specified (e.g., 95%, 96%, 97%, 98%, or 99% of the whole amount specified) according to other embodiments of the invention.

The terms "polymer" or "polymeric", as used interchangeably herein, may comprise homopolymers, copolymers, such as, for example, block, graft, random, and alternating copolymers, terpolymers, etc., and blends and modifications thereof. Furthermore, unless otherwise specifically limited, the term "polymer" or "polymeric" shall include all possible structural isomers; stereoisomers including, without limitation, geometric isomers, optical isomers or enantiomers; and/or any chiral molecular configuration of such polymer or polymeric material. These configurations include, but are not limited to, isotactic, syndiotactic, and atactic configurations of such polymer or polymeric material. The term "polymer" or "polymeric" shall also include polymers made from various catalyst systems including, without limitation, the Ziegler-Natta catalyst system and the metallocene/single-site catalyst system. The term "polymer" or "polymeric" shall also include, in according to certain embodiments of the invention, polymers produced by fermentation process or biosourced.

The terms "nonwoven" and "nonwoven web", as used herein, may comprise a web having a structure of individual fibers, filaments, and/or threads that are interlaid but not in an identifiable repeating manner as in a knitted or woven fabric. Nonwoven fabrics or webs, according to certain embodiments of the invention, may be formed by any process conventionally known in the art such as, for example, meltblowing processes, spunbonding processes, needle-punching, hydroentangling, air-laid, and bonded carded web processes. A "nonwoven web", as used herein, may comprise a plurality of individual fibers that have not been subjected to a consolidating process.

The terms "fabric" and "nonwoven fabric", as used herein, may comprise a web of fibers in which a plurality of the fibers are mechanically entangled or interconnected, fused together, and/or chemically bonded together. For example, a nonwoven web of individually laid fibers may be subjected to a bonding or consolidation process to bond at least a portion of the individually fibers together to form a coherent (e.g., united) web of interconnected fibers.

The term "consolidated" and "consolidation", as used herein, may comprise the bringing together of at least a portion of the fibers of a nonwoven web into closer proximity or attachment there-between (e.g., thermally fused together, chemically bonded together, and/or mechanically entangled together) to form a bonding site, or bonding sites, which function to increase the resistance to external forces (e.g., abrasion and tensile forces), as compared to the unconsolidated web. The bonding site or bonding sites, for example, may comprise a discrete or localized region of the web material that has been softened or melted and optionally subsequently or simultaneously compressed to form a discrete or localized deformation in the web material. Furthermore, the term "consolidated" may comprise an entire nonwoven web that has been processed such that at least a portion of the fibers are brought into closer proximity or attachment there-between (e.g., thermally fused together, chemically bonded together, and/or mechanically entangled together), such as by thermal bonding or mechanical entanglement (e.g., hydroentanglement) as merely a few examples. Such a web may be considered a "consolidated nonwoven", "nonwoven fabric" or simply as a "fabric" according to certain embodiments of the invention.

The term "staple fiber", as used herein, may comprise a cut fiber from a filament. In accordance with certain embodiments, any type of filament material may be used to form staple fibers. For example, staple fibers may be formed from polymeric fibers, and/or elastomeric fibers. Non-limiting examples of materials may comprise polyolefins (e.g., a polypropylene or polypropylene-containing copolymer), polyethylene terephthalate, and polyamides. The average length of staple fibers may comprise, by way of example only, from about 2 centimeter to about 15 centimeter.

The term "spunbond", as used herein, may comprise fibers which are formed by extruding molten thermoplastic material as filaments from a plurality of fine, usually circular, capillaries of a spinneret with the diameter of the extruded filaments then being rapidly reduced. According to an embodiment of the invention, spunbond fibers are generally not tacky when they are deposited onto a collecting surface and may be generally continuous as disclosed and described herein. It is noted that the spunbond used in certain composites of the invention may include a nonwoven described in the literature as SPINLACE®. Spunbond fibers, for example, may comprises continuous fibers.

As used herein, the term "continuous fibers" refers to fibers which are not cut from their original length prior to being formed into a nonwoven web or nonwoven fabric. Continuous fibers may have average lengths ranging from greater than about 15 centimeters to more than one meter, and up to the length of the web or fabric being formed. For example, a continuous fiber, as used herein, may comprise a fiber in which the length of the fiber is at least 1,000 times larger than the average diameter of the fiber, such as the length of the fiber being at least about 5,000, 10,000, 50,000, or 100,000 times larger than the average diameter of the fiber.

The term "meltblown", as used herein, may comprise fibers formed by extruding a molten thermoplastic material through a plurality of fine die capillaries as molten threads or filaments into converging high velocity, usually hot, gas (e.g. air) streams which attenuate the filaments of molten thermoplastic material to reduce their diameter, which may be to microfiber diameter, according to certain embodiments of the invention. According to an embodiment of the invention, the die capillaries may be circular. Thereafter, the meltblown fibers are carried by the high velocity gas stream and are deposited on a collecting surface to form a web of randomly disbursed meltblown fibers. Meltblown fibers may comprise microfibers which may be continuous or discontinuous and are generally tacky when deposited onto a collecting surface. Meltblown fibers, however, are shorter in length than those of spunbond fibers.

The term "layer", as used herein, may comprise a generally recognizable combination of similar material types and/or functions existing in the X-Y plane.

The term "multi-component fibers", as used herein, may comprise fibers formed from at least two different polymeric materials (e.g., two or more) extruded from separate extruders but spun together to form one fiber. The term "bicomponent fibers", as used herein, may comprise fibers formed from two different polymeric materials extruded from separate extruders but spun together to form one fiber. The polymeric materials or polymers are arranged in a substantially constant position in distinct zones across the cross-section of the multi-component fibers and extend continuously along the length of the multi-component fibers. The configuration of such a multi-component fibers may be, for example, a sheath/core arrangement wherein one polymer is surrounded by another, an eccentric sheath-core configuration including a sheath component and core component, in which the core component defines at least a portion of an outer surface of the bicomponent fiber having the eccentric sheath-core configuration, or may be a side-by-side arrangement, or a pie arrangement, or an "islands-in-the-sea" arrangement, each as is known in the art of multicomponent, including bicomponent, fibers.

The term "monocomponent fibers", as used herein may comprise fibers formed from a single polymer or polymeric blend (e.g., a blend or mixture of two or more polymers) extruded from a single extruder. The single polymer or polymeric blend, for example, may define a polymeric matrix in which one or more additives (e.g., fillers) may be dispersed.

The term "high-loft", as used herein, comprises a material that may have a z-direction thickness generally in excess of about 0.3 mm and a relatively low bulk density. The thickness of a "high-loft" nonwoven and/or layer may be greater than 0.3 mm (e.g., greater than 0.4 mm, greater than 0.5 mm, greater than 0.6 mm, greater than 0.8 mm, or greater than 1 mm) as determined utilizing a ProGage Thickness tester (model 89-2009) available from Thwig-Albert Instrument Co. (West Berlin, New Jersey 08091), which utilizes a 2" diameter foot, having a force application of 1.45 kPa during measurement. In accordance with certain embodiments of the invention, the thickness of a "high-loft" nonwoven and/or layer may be at most about any of the following: 3, 2.75, 2.5, 2.25, 2, 1.75, 1.5, 1.25, 1.0, 0.75, and 0.5 mm and/or at least about any of the following: 0.3, 0.4, 0.5, 0.75, 1.0, 1.25, 1.5, 1.75, and 2.0 mm. "High-loft" nonwovens and/or layers, as used herein, may additionally have a relatively low density (e.g., bulk density–weight per unit volume), such as less than about 60 kg/m$^3$, such as at most about any of the following: 70, 60, 55, 50, 45, 40, 35, 30, and 25 kg/m$^3$ and/or at least about any of the following: 10, 15, 20, 25, 30, 35, 40, 45, 50, and 55 kg/m$^3$.

The term "machine direction" or "MD", as used herein, comprises the direction in which the fabric produced or conveyed. The term "cross-direction" or "CD", as used herein, comprises the direction of the fabric substantially perpendicular to the MD.

As used herein, the term "aspect ratio", comprise a ratio of the length of the major axis to the length of the minor axis of the cross-section of the fiber in question.

All whole number end points disclosed herein that can create a smaller range within a given range disclosed herein are within the scope of certain embodiments of the invention. By way of example, a disclosure of from about 10 to about 15 includes the disclosure of intermediate ranges, for example, of: from about 10 to about 11; from about 10 to about 12; from about 13 to about 15; from about 14 to about 15; etc. Moreover, all single decimal (e.g., numbers reported to the nearest tenth) end points that can create a smaller range within a given range disclosed herein are within the scope of certain embodiments of the invention. By way of example, a disclosure of from about 1.5 to about 2.0 includes the disclosure of intermediate ranges, for example, of: from about 1.5 to about 1.6; from about 1.5 to about 1.7; from about 1.7 to about 1.8; etc.

In one aspect, the present invention provides a nonwoven fabric comprising a plurality of crimped bicomponent fibers having a first component comprising a first polymeric material comprising a first polymer or a first polymeric blend and a second component comprising a second polymeric material, in which the second polymeric material comprises a second polymeric blend of (i) at least one polypropylene polymer, (ii) at least one polyethylene polymer, and (iii) at least one compatibilizer comprising or consisting of at least one polypropylene-polyethylene copolymer. In accordance with certain embodiments of the invention, the nonwoven fabric comprises a high-loft nonwoven fabric, in which the plurality of crimped bicomponent fibers impart a desired loftiness (e.g., thickness in a z-direction that is perpendicular to the cross-direction and machine direction of the nonwoven fabric).

FIG. 1, for instance, illustrates a crimped bicomponent fiber 50 in accordance with certain embodiments of the invention, in which the crimped bicomponent fiber 50 includes plurality of three-dimensional coiled or helically shaped crimped portions. Although the crimped bicomponent fiber 50 of figure one illustrates a plurality of three-dimensional coiled or helically shaped crimped portions, the crimped bicomponent fiber may additionally or alternatively include at least one discrete zig-zag configured crimped portion, at least one discrete helically configured crimped portion, or a combination thereof.

In accordance with certain embodiments of the invention, the plurality of crimped bicomponent fibers may comprises an average free crimp percentage from about 30% to about 300%, such as at most about any of the following: 300, 275, 250, 225, 200, 175, 150, 125, 100, and 75% and/or at least about any of the following: 20, 30, 40, 50, 75, 100, 125, 150, 175, and 200%. Additionally or alternatively, the plurality of crimped bicomponent fibers comprises an average free crimp length of from about 10 mm to about 50 mm, such as at least about any of the following: 10, 12, 14, 15, 16, 18, 20, 22, 24, and 25 mm, and/or at most about any of the following: 50, 45, 40, 38, 35, 32, 30, 28, and 25 mm. The average free crimp percentage may be ascertained by determining the free crimp length of the fibers in question with an Instron 5565 equipped with a 2.5N load cell. In this regard, free or unstretched fiber bundles may be placed into clamps of the machine. The free crimp length can be measured at the point where the load (e.g., 2.5 N load cell) on the fiber bundle becomes constant. The following parameters are used to determine the free crimp length: (i) Record the Approximate free fibers bundle weight in grams (e.g., xxx g±0.002 grams); (ii) Record the Unstretched bundle length in inches; (iii) Set the Gauge Length (i.e., the distance or gap between the clamps holding the bundle of fibers) of the Inston to 1 inch; and (iv) Set the Crosshead Speed to 2.4 inches/minute. The free crimp length of the fibers in question may then be ascertained by recording the extension length of the fibers at the point where the load becomes constant (i.e., the fibers are fully extended). The average free crimp percentage may be calculated from the free crimp length of the fibers in question and the unstretched fiber bundles length (e.g., the gauge length). For example, a measured free crimp length of 32 mm when using a 1 inch (25.4 mm) gauge length as discussed above would provide an average free crimp percentage of about 126%. The foregoing method to determining the average free crimp percentage may be particularly beneficial when evaluating continuous fibers having helically coiled crimps. For instance, traditional textile fibers are mechanically crimped and can be measured optically but continuous fibers having helically coiled crimped portions cause errors in trying to optically count "crimp" in such fibers.

In accordance with certain embodiments of the invention, the plurality of crimped bicomponent fibers may comprise a plurality of three-dimensional crimped portions having an average diameter (e.g., based on the average of the longest length defining an individual crimped portion) from about 0.5 mm to about 5 mm, such as at most about any of the following: 5, 4.75, 4.5, 4.25, 4, 3.75, 3.5, 3.25, 3, 2.9, 2.8, 2.7, 2.6, 2.5, 2.4, 2.3, 2.2, 2.1, 2, 1.9, 1.8, 1.7, 1.6, and 1.5 mm and/or at least about any of the following: 0.5, 0.6, 0.07, 0.8, 0.9, 1, 1.1, 1.2, 1.3, 1.4, 1.5, 1.6, 1.7, 1.8, 1.9, and 2 mm. In accordance with certain embodiments of the invention, the average diameter of the plurality of three-dimensional crimped portions can be ascertained by use of a digital optical microscope (Manufactured by HiRox in Japan KH-7700) to view multicomponent fibers samples and obtain digital measurement of loop diameters of the three-dimensional crimped portions of the SMFs. Magnification ranges generally in the 20× to 40× can be used to ease evaluation of the loop diameter formed from the three-dimensional crimping of the multicomponent fibers.

In accordance with certain embodiments of the invention, the plurality of crimped bicomponent fibers may comprise a plurality of three-dimensional crimped portions having an average diameter (e.g., based on the average of the longest length defining an individual crimped portion) from about 10 mm to about 40 mm, such as at most about any of the following: 40, 38, 35, 32, 30, 28, and 25 mm and/or at least about any of the following: 10, 12, 15, 18, 20, 22, and 25 mm. In accordance with certain embodiments of the invention, the average diameter of the plurality of three-dimensional crimped portions can be ascertained by use of a digital optical microscope (Manufactured by HiRox in Japan KH-7700) to view multicomponent fibers samples and obtain digital measurement of loop diameters of the three-dimensional crimped portions of the SMFs. Magnification ranges generally in the 20× to 40× can be used to ease evaluation of the loop diameter formed from the three-dimensional crimping of the multicomponent fibers.

In accordance with certain embodiments of the invention, the first polymeric material may comprise a polyolefin, such as one or more polypropylenes, one or more polyethylenes, or any combination thereof. For example, the first polymeric material may comprise a total polymeric content attributed to a single polymer or a first polymeric blend comprising, for example, a first polypropylene having a first melt flow rate (MFR) and a second polypropylene having a second MFR, in which the second MFR is the same as or larger than the first MFR. In accordance with certain embodiments of the invention, a first MFR-ratio between the second MFR and the first MFR is at least about 1:1, such as at least about any of the following: 1:1, 1.2:1, 1.4:1, 1.5:1, 1.6:1, 1.8:1, 2:1, 4:1, 5:1, 6:1, 8:1, 10:1, 12:1, 14:1, 16:1, 18:1, 20:1. 22:1, 24:1, and 25:1, and/or at most about any of the following: 60:1, 55:1. 50:1, 48:1, 46:1. 45:1. 44:1. 42:1, 40:1. 38:1. 36:1. 35:1, 34:1, 32:1, 30:1, 28:1. 26:1, and 25:1.

In accordance with certain embodiments of the invention, the first polymeric material may comprise from about 70 wt. % to about 99 wt. % of the first polypropylene, such as at least about any of the following: 70, 75, 80, 85, and 90 wt. %, and/or at most about any of the following: 99, 98, 97, 96, 95, 94, 93, 92, 91, and 90 wt. %. Additionally or alternatively, the first polymeric material may comprise from about 1 wt. % to about 10 wt. % of the second polypropylene, such as at least about any of the following: 1, 2, 3, 4, and 5 wt. %, and/or at most about any of the following: 10, 9, 8, 7, 6, and 5 wt. %.

In accordance with certain embodiments of the invention, first polypropylene of the first polymeric material may have an MFR (i.e., the first MFR) from about 10 g/10 min. to about 100 g/10 min. as determined by ASTM D1238 (230° C./2.16 kg), such as at least about any of the following: 10, 15, 20, 22, 25, 28, 30, 32, 35, 38, and 40 g/10 min. as determined by ASTM D1238 (230° C./2.16 kg), and/or at most about any of the following: 100, 90, 80, 70, 60, 50, and 40 g/10 min. as determined by ASTM D1238 (230° C./2.16 kg). Additionally or alternatively, the second polypropylene of the first polymeric material may have an MFR (i.e., the second MFR) from about 500 g/10 min. to about 2500 g/10 min. as determined by ASTM D1238 (230° C./2.16 kg), such as at least about any of the following: 500, 550, 600, 700, 800, 900, 1000, 1200, 1500, and 1800 g/10 min. as determined by ASTM D1238 (230° C./2.16 kg), and/or at most about any of the following: 2500, 2400, 2300, 2200, 2100, 2000, 1900, and 1800 g/10 min. as determined by ASTM D1238 (230° C./2.16 kg).

In accordance with certain embodiments of the invention, the second polymeric blend may comprise from about 60 wt. % to about 90 wt. % of the at least one polypropylene polymer (e.g., a single polypropylene polymer or a combination of polypropylene polymers), such as at least about any of the following: 60, 62, 64, 65, 66, 68, 70, 72, 74, 77, 78, and 80 wt. % of the at least one polypropylene polymer, and/or at most about any of the following: 90, 88, 86, 85, 84, 83, 82, 81, and 80 wt. % of the at least one polypropylene polymer. For example, the at least one polypropylene polymer may be a first polypropylene polymer, which may be the same or different from the first polypropylene used in the first polymeric blend, and/or a second polypropylene polymer, which may be the same or different from the second polypropylene used in the first polymeric blend). In accordance with certain embodiments of the invention, the at least one polypropylene polymer (e.g., a single polypropylene polymer or a combination of polypropylene polymers) of the second polymeric blend may have a melt flow rate (MFR) of from about 10 to about 150 g/10 min as determined by ASTM D1238 (230° C./2.16 kg), such as at least about any of the following: 10, 12, 14, 16, 18, 20, 22, 24, 25, 26, 28, 30, 32, 34, 35, 36, 38, 40, 42, 44, 45, 46, 48, and 50 g/10 min, and/or at most about any of the following: 150, 140, 130, 120, 110, 100, 95, 90, 85, 80, 75, 70, 65, 60, 58, 56, 55, 54, 52, and 50 g/10 min. For example, the second polymeric blend may include a plurality of different polypropylene polymers and the weight averaged MFR for the combination of the plurality of different polypropylene polymers may reside within any of the aforementioned ranges.

In accordance with certain embodiments of the invention, the second polymeric blend may comprise from about 5 to about 30 wt. % of the at least one polyethylene polymer, such as at least about any of the following: 5, 6, 8, 10, 12, 14, and 15 wt. % of the at least one polyethylene polymer, and/or at most about any of the following: 30, 28, 26, 25, 24, 22, 20, 18, 16, and 15 wt. % of the at least one polyethylene polymer. For example, the at least one polyethylene polymer may be a first polyethylene polymer. In accordance with certain embodiments of the invention, the at least one polyethylene polymer may have a melt flow rate (MFR) of from about 1 to about 40 g/10 min as determined by ASTM D1238 (190° C./2.16 kg), such as at least about any of the following: 1, 2, 4, 5, 6, 8, 10, 12, 14, and 15 g/10 min, and/or at most about any of the following: 40, 35, 30, 25, 20, 18, 16, and 15 g/10 min.

In accordance with certain embodiments of the invention, the second polymeric blend may comprise from about 1 wt. % to about 10 wt. % of the at least one polypropylene-polyethylene copolymer (e.g., compatibilizer), such as at least about any of the following: 1, 2, 3, 4, and 5 wt. % of the at least one polypropylene-polyethylene copolymer, and/or at most about any of the following: 10, 9, 8, 7, 6, and 5 wt. % of the at least one polypropylene-polyethylene copolymer. The at least one polypropylene-polyethylene copolymer, for example, may be a first polypropylene-polyethylene copolymer (e.g., a single polypropylene-polyethylene copolymer). The first polypropylene-polyethylene copolymer may comprise a first block copolymer or a first random copolymer. In accordance with certain embodiments of the invention, the first polypropylene-polyethylene copolymer is an EP-iPP diblock polymer.

The first polypropylene-polyethylene copolymer, in accordance with certain embodiments of the invention, may have an ethylene monomer content from about 5 to about 60% by weight, such as at least about any of the following: 5, 6, 8, 10, 12, 14, 15, 16, 18, 20, 22, 24, 25, 26, 28, 30, 32, 34, 35, 26, 38, 40, 42, 44, and 45% by weight, and/or at most about any of the following: 60, 58, 56, 55, 54, 52, 50, 48, 46, and 45% by weight. Additionally or alternatively, the at least one polypropylene-polyethylene copolymer (e.g., first polypropylene-polyethylene copolymer) may have a melt flow rate (MFR) of from about 0.5 g/10 min to about 20 g/10 min as determined by ASTM D1238 (230° C./2.16 kg), such as at least about the any of the following: 0.5, 1, 1.5, 2, 2.5, 3, 3.5, 4, 4.5, 5, 5.5, 6, 6.5, 7, 7.5, 8, 8.5, 9, 9.5, and 10 g/10 min as determined by ASTM D1238 (230° C./2.16 kg), and/or at most about any of the following: 20, 19, 18, 17, 16, 15, 14, 13, 12, 11, and 10 g/10 min as determined by ASTM D1238 (230° C./2.16 kg). In accordance with certain embodiments of the invention, a second MFR-ratio between a third MFR of the at least one polypropylene polymer as determined by ASTM D1238 (230° C./2.16 kg) and a fourth MFR of the at least one polyethylene polymer as determined by ASTM D1238 (230° C./2.16 kg) in the second polymeric material may be from about 5:1 to about 20:1, such as at least about any of the following: 5:1, 6:1, 7:1, 8:1, 9:1, 10:1, 11:1, and 12:1, and/or at most about any of the following: 20:1, 19:1, 18:1, 17:1, 16:1, 15:1, 14:1, 13:1, and 12:1. Additionally or alternatively, the second polymeric blend may have a MFR from about 20 to about 120 g/10 min as determined by ASTM D1238 (230° C./2.16 kg), such as at least about any of the following: 20, 22, 24, 25, 26, 28, 30, 32, 34, 35, 36, 38, and 40 g/10 min as determined by ASTM D1238 (230° C./2.16 kg), and/or at most about any of the following: 120, 110, 100, 90, 80, 70, 60, 59, 58, 56, 55, 54, 52, 50, 49, 48, 47, 46, 45, 44, 43, 42, 41, and 40 g/10 min as determined by ASTM D1238 (230° C./2.16 kg).

In this regard, recent advances in single-site catalysts (e.g., metallocene catalysts) have allowed creation of variety of polymer structures that were difficult or impossible to create economically. In this regard, the first polypropylene-polyethylene copolymer may comprise a copolymer formed from a single-site catalyst, such as a metallocene-catalyzed copolymer. For example, polypropylene-based polymers with significant amounts of ethylene content can be produced in a variety of configurations (e.g., well-defined blocks) to further enhance the copolymers' ability to bridge the generally immiscible polymers. An example of such a material includes Vistamaxx™ (e.g., Vistamaxx™ 6202), a polypropylene-based elastomer that comprises a copolymer of propylene and ethylene. These propylene-based elastomers, for example, comprise isotactic polypropylene microcrystalline regions and random amorphous regions (e.g., ethylene). Such olefinic copolymers may comprise hard blocks and soft blocks, where the hard blocks are primarily propylene and the soft blocks are primarily ethylene. In this regard, the hard blocks (e.g., propylene) may comprise 10-90% by weight of the copolymer while the soft blocks may comprise from 90-10% by weight of the copolymer. In this regard, these copolymers include a random ethylene distribution throughout the copolymer. Vistamaxx™ (e.g., Vistamaxx™ 6202) copolymers are commercially available from ExxonMobil. Vistamaxx™ 6202 has a density of 0.862 g/cc, a MI (190 C/2.16 kg) of 9.1, a MFR (230 C/2.16 kg load) of 20, and an ethylene content of 15% by weight. An additional example includes an olefin diblock copolymer comprising an EP-iPP diblock polymer such as Intune™, which is a polypropylene-based block copolymer including ethylene monomers. In accordance with certain embodiments of the invention, the first polypropylene-polyethylene copolymer disclosed herein may be prepared, for example, by a process comprising contacting an addition polymerizable monomer or mixture of monomers under addition polymerization conditions with a composition comprising at least one addition polymerization catalyst, a co-catalyst and a chain shuttling agent ("CSA"), in which the process is characterized by formation of at least some of the growing polymer chains under differentiated process conditions in two or more reactors operating under steady state polymerization conditions or in two or more zones of a reactor operating under plug flow polymerization conditions. In accordance with certain embodiments of the invention, the first polypropylene-polyethylene copolymer may comprise an olefin block copolymer formed from a single-site catalyst or other catalyst systems. That is, the first polypropylene-polyethylene copolymer may not be produced from a single-site catalyst in accordance with certain embodiments of the invention. In accordance with certain embodiments of the invention, the first polypropylene-polyethylene copolymer is devoid of anhydride functionality, such as maleic anhydride functionality.

In accordance with certain embodiments of the invention, the copolymers formed from a single-site catalyst as discussed above may be differentiated from conventional, random copolymers, physical blends of polymers, and block copolymers prepared via sequential monomer addition. These copolymers may be differentiated from random copolymers by characteristics such as higher melting temperatures for a comparable amount of comonomer, block composite index, as described below; differentiated from a physical blend by characteristics such as block composite index, better tensile strength, improved fracture strength, finer morphology, improved optics, and greater impact strength at lower temperature; differentiated from block copolymers prepared by sequential monomer addition by molecular weight distribution, rheology, shear thinning, rheology ratio, and in that there is block polydispersity.

By way of further examples, the first polypropylene-polyethylene copolymer may comprise an EP-iPP diblock polymer that has an ethylene content from 43 to 48% by weight, or from 43.5 to 47% by weight, or from 44 to 47% by weight, based on the weight of the diblock copolymer. In an example embodiment, the EP-iPP diblock polymer may have a propylene content from 57 to 52% by weight, or from 56.5 to 53% by weight, or from 56 to 53% by weight, based on the weight of the EP-iPP diblock polymer.

In accordance with certain embodiments of the invention, the plurality of crimped bicomponent fibers have an average diameter (e.g., fiber diameter) from about 10 to about 30 microns, such as at least about any of the following: 10, 12, 14, 15, 16, 18, and 20 microns, and/or at most about any of the following: 30, 28, 26, 25, 24, 22, and 20 microns. Additionally or alternatively, the plurality of crimped bicomponent fibers may comprise continuous fibers, such as spunbond fibers, staple fibers, or a combination thereof.

In accordance with certain embodiments of the invention, the plurality of crimped bicomponent fibers may comprise a side-by-side configuration (e.g., round or non-round cross-section), a sheath-core configuration, a pie configuration, an islands-in-the-sea configuration, a multi-lobed configuration, or any combinations thereof. For example, the sheath-core configuration may comprise an eccentric sheath-core configuration including a sheath component and core component, in which the core component defines at least a portion of an outer surface of the plurality of bicomponent fibers having the eccentric sheath-core configuration.

Figure 2A:
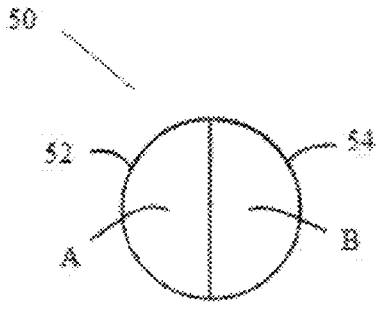
Figure 2B:
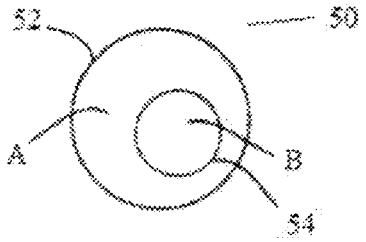
Figure 2C:
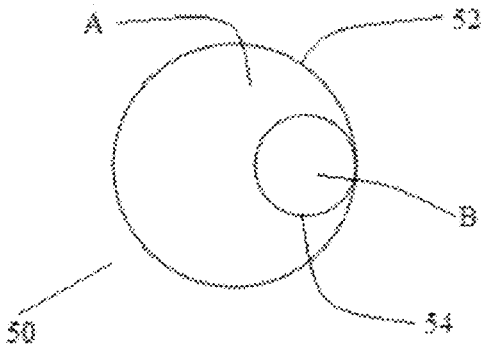
Figure 2D:
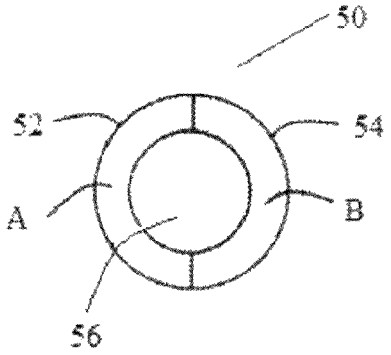
Figure 2E:
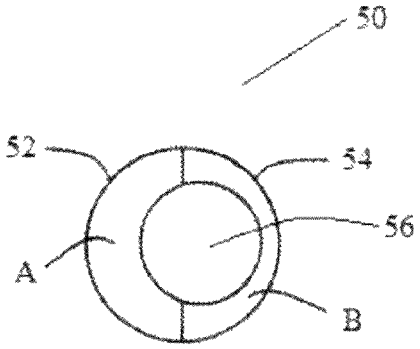
Figure 2F:
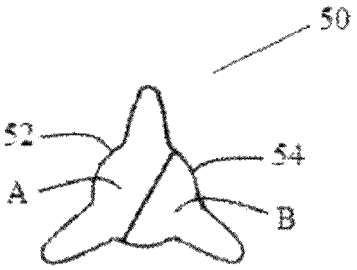
Figure 2G:
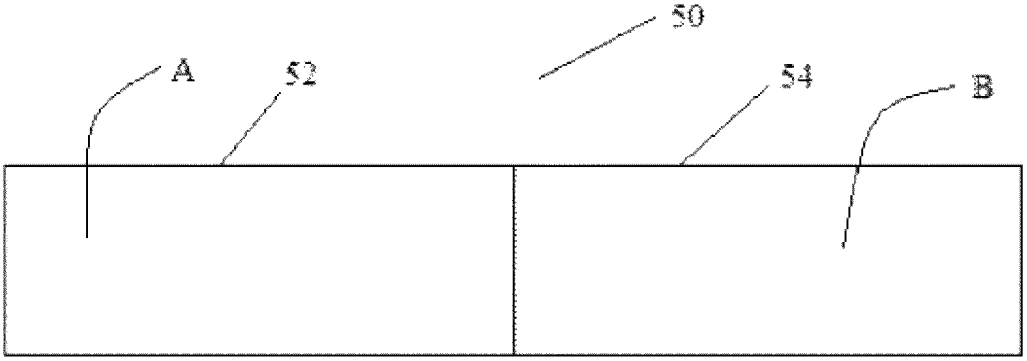
Figure 2H:
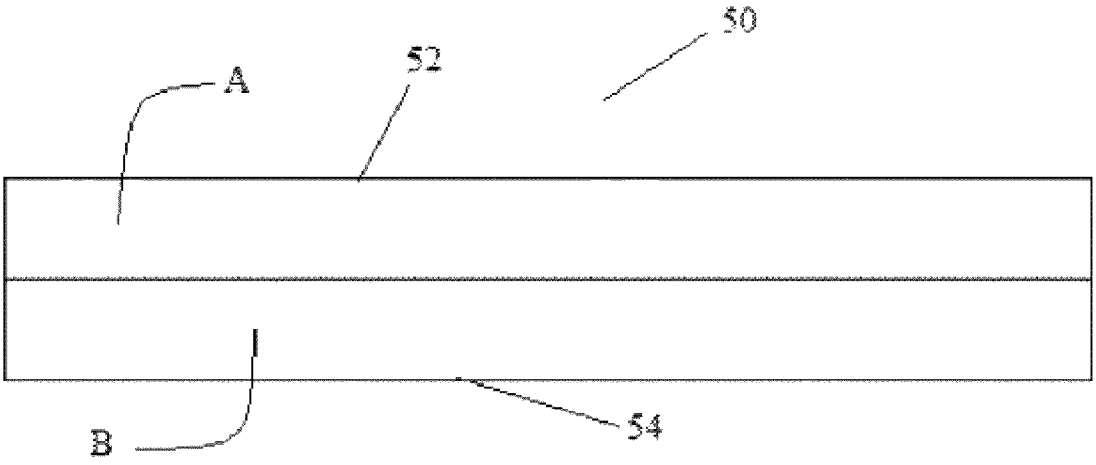

FIGS. 2A-2H illustrate examples of cross-sectional views for some non-limiting examples of the plurality of crimped bicomponent fibers in accordance with certain embodiments of the invention. As illustrated in FIG. 2A-2H, the plurality of crimped bicomponent fibers 50 may comprise a first polymeric component 52 of a first polymeric composition A, such as disclosed and described herein, and a second polymeric component 54 of a second polymeric composition B, such as disclosed and described herein. The first and second components 52 and 54 can be arranged in substantially distinct zones within the cross-section of the plurality of crimped bicomponent fibers that extend substantially continuously along the length of the bicomponent fibers. The first and second components 52 and 54 can be arranged in a side-by-side arrangement in a round cross-sectional fiber as depicted in FIG. 2A or in a ribbon-shaped (e.g., non-round) cross-sectional fiber as depicted in FIGS. 2G and 2H. Additionally or alternatively, the first and second components 52 and 54 can be arranged in a sheath/core arrangement, such as an eccentric sheath/core arrangement as depicted in FIGS. 2B and 2C. In the eccentric sheath/core bicomponent fibers as illustrated in FIG. 2B, one component fully occludes or surrounds the other but is asymmetrically located in the multicomponent fibers to allow fiber crimp (e.g., first component 52 surrounds component 54). Eccentric sheath/core configurations as illustrated by FIG. 2C include the first component 52 (e.g., the sheath component) substantially surrounding the second component 54 (e.g., the core component) but not completely as a portion of the second component may be exposed and form part of the outermost surface of the fiber 50. As additional examples, the bicomponent fibers can comprise hollow fibers as shown in FIGS. 2D and 2E or as multilobal fibers as shown in FIG. 2F. It should be noted, however, that numerous other cross-sectional configurations and/or fiber shapes may be suitable in accordance with certain embodiments of the invention.

In the plurality of crimped bicomponent fibers, in accordance with certain embodiments of the invention, the respective polymer components can be present in ratios (by volume or my mass) of from about 85:15 to about 15:85. Ratios of approximately 50:50 (by volume or mass) may be desirable in accordance with certain embodiments of the invention; however, the particular ratios employed can vary as desired, such as at most about any of the following: 85:15, 80:20, 75:25, 70:30, 65:35, 60:40, 55:45 and 50:50 by volume or mass and/or at least about any of the following: 50:50, 45:55, 40:60, 35:65, 30:70, 25:75, 20:80, and 15:85 by volume or mass. Additionally or alternatively, the first polymeric material may comprise from about 20 wt. % to about 80 wt. % of the plurality of crimped bicomponent fibers, such as at least about any of the following: 20, 25, 30, 35, 40, 45, 50, and 55 wt. %, and/or at most about any of the following: 80, 75, 70, 65, 60, and 55 wt. %. Additionally or alternatively, the second polymeric material may comprise from about 20 wt. % to about 80 wt. % of the plurality of crimped bicomponent fibers, such as at least about any of the following: 20, 25, 30, 35, 40, 45, 50, and 55 wt. %, and/or at most about any of the following: 80, 75, 70, 65, 60, and 55 wt. %.

In accordance with certain embodiments of the invention, the first polymeric blend, the second polymeric blend, or both may comprise less than about 10% by weight to a total polypropylene-polyethylene copolymer, such as from at least about any of the following: 0, 0.5, 1, 2, 3, 4, and 5% by weight, and/or at most about any of the following: 10, 9, 8, 7, 6, and 5% by weight. In this regard, the bicomponent fiber may comprise a total polymer component having less than about 10% by weight to a total polypropylene-polyethylene copolymer, such as from at least about any of the following: 0, 0.5, 1, 2, 3, 4, and 5% by weight, and/or at most about any of the following: 10, 9, 8, 7, 6, and 5% by weight.

In accordance with certain embodiments of the invention, the second polymeric material may optionally further comprise a compatibilizer comprising an anhydride functionality, such as maleic anhydride or maleic anhydride modified polymers. Additionally or alternatively, the first polymeric material, second polymeric material, or both may further comprises one or more fillers, such as one or more organic fillers and/or one or more inorganic fillers (e.g., particulates of calcium carbonate, pigments, etc.). In accordance with certain embodiments of the invention, the first polymeric material, second polymeric material, or both may further comprises one or more slip agents, such as an amide. The one or more slip agents for example, may comprise a primary amide, a secondary amide, a tertiary amide, a bis-amide, or any combination thereof. In accordance with certain embodiments of the invention, the one or more slip agents may comprise one or more primary amides. By way of example, primary amides suitable as a slip agent in accordance with certain embodiments of the invention may comprise erucamide, oleamide, stearamide, behenamide, or any combination thereof. Alternatively or additionally, certain embodiments of the invention may comprise one or more slip agents comprising one or more secondary amides. By way of example, secondary amides suitable as slip agents in accordance with certain embodiments of the invention comprise oleyl palmitamide, stearyl erucamide, or any combination thereof. Alternatively or additionally, certain embodiments of the invention may comprise one or more slip agents comprising one or more bis-amides, such as ethylene bis-amides. By way of example, bis-amides suitable as a slip agents in accordance with certain embodiments of the invention comprise ethylene bis-stearamide, ethylene bis-oleamide, or any combination thereof. Slip agents, in accordance with certain embodiments of the invention, may comprise an amide (e.g., a primary amide, a secondary amide, a tertiary amide, bis-amide, etc.) including one or more saturated or unsaturated aliphatic chains. In accordance with certain embodiments of the invention, the one or more aliphatic chains may each independently comprise from about 1 to about 30 carbon atoms (e.g., about 5 to about 30 carbon atoms). For example, a secondary amides and bis-amides may comprise two saturated and/or unsaturated carbon chains the may each independently comprise from about 1 to about 30 carbon atoms (e.g., about 5 to about 30 carbon atoms). By way of example only, the one or more aliphatic chains may each independently comprise from at least about any of the following: 1, 5, 10, 15, 16, 17, 18, 19, 20, 21, 22, 23, 24, and 25 carbon atoms and/or at most about 30, 29, 28, 27, 26, 25, 20, and 15 carbon atoms (e.g., about 15 to about 25 carbon atoms, about 20 to 30 carbon atoms, etc.). In accordance with certain embodiments of the invention, the slip agent may comprise an amide including an unsaturated aliphatic chain having one or more elements or unsaturation. An element of unsaturation corresponds to two fewer hydrogen atoms than in the saturated formula. For example, a single double bound accounts for one element of unsaturation, while a triple bond would account for two elements of unsaturation. In accordance with certain embodiments of the invention, the slip agent includes an unsaturated aliphatic chain comprising from about 1 to about 10 elements of unsaturation (e.g., 1, 2, 3, 4, 5, 6, 7, 8, 9, or 10 elements of saturation).

As noted above, the plurality of crimped bicomponent fibers may comprise a round cross-section, non-round cross-section, or both. For example, the non-round cross-section may comprise a pie-shaped cross-section, a multilobal cross-section, or a ribbon-shaped cross-section. In accordance with certain embodiments of the invention, the plurality of crimped bicomponent fibers comprise a non-round cross-section having an aspect ratio of at least about 1.5:1, such as from about 1.5:1 to about 10:1.

In accordance with certain embodiments of the invention, the plurality of crimped bicomponent fibers may comprise from about 0 to about 100 wt. % of round cross-sectional fibers, such as at least about any of the following: 0, 5, 10, 20, 30, 40, and 50 wt. %, and/or at most about any of the following: 100, 95, 90, 80, 70, 60, and 50 wt. %. Additionally or alternatively, the plurality of crimped bicomponent fibers may comprise from about 0 to about 100 wt. % of non-round cross-sectional fibers, such as at least about any of the following: 0, 5, 10, 20, 30, 40, and 50 wt. %, and/or at most about any of the following: 100, 95, 90, 80, 70, 60, and 50 wt. %.

In accordance with certain embodiments of the invention, the plurality of crimped bicomponent fibers define a first nonwoven layer, and the nonwoven fabric further comprises one or more additional nonwoven layers including, for example, at least a second nonwoven layer. In this regard, the nonwoven fabric may comprise a multilayer nonwoven fabric. The one or more additional layers, for example, may comprise a spunbond layer, a meltblown layer, a carded layer, a hydroentangled layer, a cellulosic layer, or any combination thereof. In accordance with certain embodiments of the invention, the nonwoven fabric includes one or more cellulosic layers located directly or indirectly between the first nonwoven layer and the second nonwoven layer, wherein the second nonwoven layer comprises a second spunbond layer or a spunbond-meltblown-spunbond layer.

In accordance with certain embodiments of the invention, the nonwoven fabric may have a basis weight of at least about 14 grams-per-square-meter (gsm), such as at least about any of the following: 14, 16, 18, 20, 22, 25, 28, 30, 32, 35, 38, 40, 42, 45, 48, 50, 52, 55, 58, and 60 gsm, and/or at most about any of the following: 100, 95, 90, 85, 80, 75, 70, 65, and 60 gsm.

In another aspect, the present invention provides a method of making a nonwoven fabric. The method may comprise the following: (a) forming a first polymeric melt comprising a first polymer or a first polymeric blend; (b) forming a second polymeric melt including a second polymeric blend of (i) at least one polypropylene polymer, (ii) at least one polyethylene polymer, and (iii) at least one compatibilizer comprising a polypropylene-polyethylene copolymer; (c) forming a plurality of bicomponent fibers via melt-spinning the first polymeric melt and the second polymeric melt through a bicomponent spinnerette pack; (d) allowing the plurality of bicomponent fibers to crimp prior to or during laydown on a collection surface or subjecting the plurality of bicomponent fibers to a crimping operation to provide a plurality of crimped bicomponent fibers; and (e) consolidating the plurality of crimped bicomponent fibers to form a nonwoven fabric. Alternatively, the method may comprise the following: (a) forming a first polymeric melt comprising a first polymer or a first polymeric blend; (b) forming a second polymeric melt including a second polymeric blend of (i) at least one polypropylene polymer, (ii) at least one polyethylene polymer, and (iii) at least one compatibilizer comprising a polypropylene-polyethylene copolymer; (c) forming a plurality of bicomponent fibers via melt-spinning the first polymeric melt and the second polymeric melt through a bicomponent spinneret pack; (d) consolidating the plurality of bicomponent fibers to form an intermediate nonwoven fabric; and (e) subjecting the plurality of bicomponent fibers of the intermediate nonwoven fabric to a crimping operation to provide a nonwoven fabric. In accordance with certain embodiments of the invention, the bicomponent spinnerette pack comprises a orifices through which the plurality of bicomponent fibers are extruded.

In accordance with certain embodiments of the invention, the step of forming the second polymeric melt comprises selecting and blending the at least one polypropylene polymer, the at least one polyethylene polymer, and the at least one polypropylene-polyethylene copolymer at an elevated temperature, in which the MFR of the at least one polyethylene polymer is less than the MFR of the at least one polypropylene polymer at the elevated temperature and a difference between the MFR of the at least one polypropylene polymer and the MFR of the at least one polyethylene polymer is less than about 35. For example, the difference between the MFR of the at least one polypropylene polymer and the MFR of the at least one polyethylene polymer may be from about 1 to about 35, such as at least about any of the following: 1, 3, 5, 8, 10, 12, 15, 18, and 20, and/or at most about any of the following: 35, 32, 20, 28, 26, 25, 24, 22, and 20. In accordance with certain embodiments of the invention, the elevated temperature may be from about 190° C. to about 250° C., such as at least about any of the following: 190, 200, 210, and 215° C., and/or at most about any of the following: 250, 245, 240, 235, 230, 225, 220, and 215° C. In accordance with certain embodiments of the invention, the first polymeric blend and the second polymeric blend may be extruded and/or meltspun at one or more of the above-referenced elevated temperatures or temperature ranges. In accordance with certain embodiments of the invention, the first polymeric blend and the second polymeric blend may be extruded and meltspun at the same elevated temperature.

In accordance with certain embodiments of the invention, the step of consolidating the plurality of bicomponent fibers or consolidating the plurality of crimped bicomponent fibers may comprise a thermal bonding operation, an ultrasonic bonding operation, a mechanical bonding operation, an adhesive bonding operation, or any combination thereof. The consolidating step, for example, may comprise forming a plurality of individual bond sites by a thermal bonding operation or an ultrasonic operation. In this regard, the plurality of individual bond sites define a bonded area. The bonded area, for instance, may comprise from about 3% to about 30% of the nonwoven fabric, such as at least about any of the following: 3, 4, 5, 6, 8, 10, 12, 14, and 15%, and/or at most about any of the following: 30, 28, 26, 25, 24, 22, 20, 18, 16, and 15%. Additionally or alternatively, the step of forming the plurality of individual bond sites may be performed at temperature from about 120° C. to about 170° C., such as at least about any of the following: 120, 122, 124, 125, 126, 128, 130, 132, 134, and 135° C., and/or at most about any of the following: 170, 160, 150, 148, 146, 145, 144, 142, 140, 138, 136, and 135° C.

In yet another aspect, the present invention provides an article comprising one or more nonwoven fabrics as described and disclosed herein. The article may comprise an adult diaper, a baby diaper, a pull-up, of a feminine hygiene pad. In accordance with certain embodiments of the invention, the article may comprise a topsheet comprising a nonwoven fabric as described and disclosed herein.

EXAMPLES

The present disclosure is further illustrated by the following examples, which in no way should be construed as being limiting. That is, the specific features described in the following examples are merely illustrative and not limiting.

Example Set 1

Nine (9) different crimped bicomponent fibers (i.e., Samples 1-9) were produced and their average free crimp length was measured. Each of the bicomponent fibers were side-by-side bicomponent fibers, in which the first polymeric material accounted for 60 wt. % of the bicomponent fiber and the second polymeric material accounted for 40 wt. % of the bicomponent fiber. The average free crimp length was measured for each of the different crimped bicomponent fibers. The results are summarized in Table 1 below.

Sample 1 was a control sample. All polymeric material consisted of 100% by weight of a polypropylene homopolymer (i.e., PP3155E5 from Exxon) having a MFR of 36 g/10 min per ASTM D1238 (230° C./2.16 kg). For Sample 2, the first polymeric material consisted of 100% by weight of a polypropylene homopolymer (i.e., PP3155E5 from Exxon) having a MFR of 36 g/10 min per ASTM D1238 (230° C./2.16 kg). The second polymeric material consisted of 100% by weight of a polypropylene copolymer commercially available as SV956 from LyondellBasell.

For Sample 3, the first polymeric material consisted of 100% by weight of a polypropylene homopolymer (i.e., PP3155E5 from Exxon) having a MFR of 36 g/10 min per ASTM D1238 (230° C./2.16 kg). The second polymeric material consisted of a blend of (i) 80% by weight of a polypropylene homopolymer (i.e., PP3155E5 from Exxon) having a MFR of 36 g/10 min per ASTM D1238 (230° C./2.16 kg), (ii) 15% by weight of a linear low density polyethylene (i.e., PE-Dowlex 2036.01G from Dow) having a MFR of 2.5 g/10 min per ASTM D1238 (190° C./2.16 kg); and (iii) 5% by weight of an EP-iPP diblock polymer (i.e., Intune™—Dow D5545) having a MFR of 9.5 g/10 min per ASTM D1238 (230° C./2.16 kg).

For Sample 4, the first polymeric material consisted of a blend of (1) 97% by weight of a polypropylene homopolymer (i.e., PP3155E5 from Exxon) having a MFR of 36 g/10 min per ASTM D1238 (230° C./2.16 kg), and (ii) 3% by weight of meltblown polypropylene having a MFR of 500 g/10 min per ASTM D1238 (230° C./2.16 kg). The second polymeric material consisted of a blend of (i) 80% by weight of a polypropylene homopolymer (i.e., PP3155E5 from Exxon) having a MFR of 36 g/10 min per ASTM D1238 (230° C./2.16 kg), (ii) 15% by weight of a linear low density polyethylene (i.e., PE-Dowlex 2036.01G from Dow) having a MFR of 2.5 g/10 min per ASTM D1238 (190° C./2.16 kg); and (iii) 5% by weight of an EP-iPP diblock polymer (i.e., Intune™—Dow D5545) having a MFR of 9.5 g/10 min per ASTM D1238 (230° C./2.16 kg).

For Sample 5, the first polymeric material consisted of 100% by weight of a polypropylene homopolymer (i.e., PP3155E5 from Exxon) having a MFR of 36 g/10 min per ASTM D1238 (230° C./2.16 kg). The second polymeric material consisted of 100% by weight of a polypropylene random copolymer commercially available as RP448S from LyondellBasell.

For Sample 6, the first polymeric material consisted of 100% by weight of a polypropylene homopolymer (i.e., PP3155E5 from Exxon) having a MFR of 36 g/10 min per ASTM D1238 (230° C./2.16 kg). The second polymeric material consisted of 100% by weight of a polypropylene copolymer commercially available as Pro-Fax SDS 242 from LyondellBasell.

For Sample 7, the first polymeric material consisted of 100% by weight of a polypropylene homopolymer (i.e., PP3155E5 from Exxon) having a MFR of 36 g/10 min per ASTM D1238 (230° C./2.16 kg). The second polymeric material consisted of 97% by weight of polypropylene homopolymer (i.e., PP3155E5 from Exxon) having a MFR of 36 g/10 min per ASTM D1238 (230° C./2.16 kg) and 3% by weight of Dowlex Polyethylene.

For Sample 8, the first polymeric material consisted of 100% by weight of a polypropylene homopolymer (i.e., PP3155E5 from Exxon) having a MFR of 36 g/10 min per ASTM D1238 (230° C./2.16 kg). The second polymeric material consisted of the following: (i) 92% by weight of a polypropylene homopolymer (i.e., PP3155E5 from Exxon) having a MFR of 36 g/10 min per ASTM D1238 (230° C./2.16 kg); (ii) 6% by weight of Dowlex Polyethylene; and (iii) 2% by weight of an EP-iPP diblock polymer (i.e., Intune™—Dow D5545) having a MFR of 9.5 g/10 min per ASTM D1238 (230° C./2.16 kg).

For Sample 9, the first polymeric material consisted of 100% by weight of a polypropylene homopolymer (i.e., PP3155E5 from Exxon) having a MFR of 36 g/10 min per ASTM D1238 (230° C./2.16 kg). The second polymeric material consisted of the following: (i) 86.5% by weight of a polypropylene homopolymer (i.e., PP3155E5 from Exxon) having a MFR of 36 g/10 min per ASTM D1238 (230° C./2.16 kg); (ii) 10% by weight of Dowlex Polyethylene; and (iii) 3.5% by weight of an EP-iPP diblock polymer (i.e., Intune™—Dow D5545) having a MFR of 9.5 g/10 min per ASTM D1238 (230° C./2.16 kg).

As shown in Table 1, Sample 3 was able to provide an average free crimp length while using a blend of a polypropylene, a polyethylene, and minor amount of a compatibilizer. In this regard, the improved average free crimp realized by Sample 3 was realized while using significantly less polypropylene copolymer. Details regarding the particular compositions of the first and second polymeric materials of each sample are more concisely summarized in Table 2.

Example Set 2

Thirteen (13) additional different crimped bicomponent fibers (i.e., Samples 10-22) were produced and their average free crimp length was measured. For these samples, each of the bicomponent fibers were side-by-side bicomponent fibers, but the respective weight percentages of the first polymeric material of the bicomponent fiber and the second polymeric material of the bicomponent fiber were varied as shown in Table 2. The average free crimp length was measured for each of the different crimped bicomponent fibers. The results are summarized in Table 1 below.

For Sample 10, the first polymeric material consisted of 100% by weight of a polypropylene homopolymer (i.e., PP3155E5 from Exxon) having a MFR of 36 g/10 min per ASTM D1238 (230° C./2.16 kg). The second polymeric material consisted of 80% by weight of polypropylene homopolymer (i.e., PP3155E5 from Exxon) having a MFR of 36 g/10 min per ASTM D1238 (230° C./2.16 kg), 15% by weight of Dowlex Polyethylene (i.e., PE-Dowlex 2036.01G from Dow) having a MFR of 2.5 g/10 min per ASTM D1238 (230° C./2.16 kg), and 5% by weight of an EP-iPP diblock polymer (i.e., Intune™—Dow D5545) having a MFR of 9.5 g/10 min per ASTM D1238 (230° C./2.16 kg). The first polymeric material accounted for 70% by weight of the bicomponent fiber, while the second polymeric material accounted for 30% by weight of the bicomponent fiber.

For Sample 11, the first polymeric material and the second polymeric material were identical to those of Sample 10. However, the first polymeric material accounted for 50% by weight of the bicomponent fiber, while the second polymeric material accounted for 50% by weight of the bicomponent fiber for Sample 11.

For Sample 12, the first polymeric material and the second polymeric material were identical to those of Sample 10. However, the first polymeric material accounted for 30% by weight of the bicomponent fiber, while the second polymeric material accounted for 70% by weight of the bicomponent fiber for Sample 12.

For Sample 13, the first polymeric material consisted of a blend of (i) 97% by weight of a polypropylene homopolymer (i.e., PP3155E5 from Exxon) having a MFR of 36 g/10 min per ASTM D1238 (230° C./2.16 kg), and (ii) 3% by weight of meltblown polypropylene having a MFR of 1800 g/10 min per ASTM D1238 (230° C./2.16 kg). The second polymeric material consisted of a blend of (i) 80% by weight of a polypropylene homopolymer (i.e., PP3155E5 from Exxon) having a MFR of 36 g/10 min per ASTM D1238 (230° C./2.16 kg), (ii) 15% by weight of a linear low density polyethylene (i.e., PE-Dowlex 2036.01G from Dow) having a MFR of 2.5 g/10 min per ASTM D1238 (190° C./2.16 kg); and (iii) 5% by weight of an EP-iPP diblock polymer (i.e., Intune™—Dow D5545) having a MFR of 9.5 g/10 min per ASTM D1238 (230° C./2.16 kg). The first polymeric material accounted for 70% by weight of the bicomponent fiber, while the second polymeric material accounted for 30% by weight of the bicomponent fiber.

For Sample 14, the first polymeric material and the second polymeric material were identical to those of Sample 13. However, the first polymeric material accounted for 50% by weight of the bicomponent fiber, while the second polymeric material accounted for 50% by weight of the bicomponent fiber for Sample 14.

For Sample 15, the first polymeric material and the second polymeric material were identical to those of Sample 13. However, the first polymeric material accounted for 30% by weight of the bicomponent fiber, while the second polymeric material accounted for 70% by weight of the bicomponent fiber for Sample 15.

For Sample 16, the first polymeric material consisted of 100% by weight of a polypropylene homopolymer (i.e., PP3155E5 from Exxon) having a MFR of 36 g/10 min per ASTM D1238 (230° C./2.16 kg). The second polymeric material consisted of a blend of (i) 77% by weight of a polypropylene homopolymer (i.e., PP3155E5 from Exxon) having a MFR of 36 g/10 min per ASTM D1238 (230° C./2.16 kg), (ii) 15% by weight of a linear low density polyethylene (i.e., PE-Dowlex 2036.01G from Dow) having a MFR of 2.5 g/10 min per ASTM D1238 (190° C./2.16 kg); (iii) 5% by weight of an EP-iPP diblock polymer (i.e., Intune™—Dow D5545) having a MFR of 9.5 g/10 min per ASTM D1238 (230° C./2.16 kg), and (iv) 3% by weight of meltblown polypropylene having a MFR of 1800 g/10 min per ASTM D1238 (230° C./2.16 kg). The first polymeric material accounted for 70% by weight of the bicomponent fiber, while the second polymeric material accounted for 30% by weight of the bicomponent fiber.

For Sample 17, the first polymeric material and the second polymeric material were identical to those of Sample 16. However, the first polymeric material accounted for 50% by weight of the bicomponent fiber, while the second polymeric material accounted for 50% by weight of the bicomponent fiber for Sample 16.

For Sample 18, the first polymeric material and the second polymeric material were identical to those of Sample 16. However, the first polymeric material accounted for 30% by weight of the bicomponent fiber, while the second polymeric material accounted for 70% by weight of the bicomponent fiber for Sample 18.

For Sample 19, the first polymeric material consisted of a blend of (i) 99% by weight of a polypropylene homopolymer (i.e., PP3155E5 from Exxon) having a MFR of 36 g/10 min per ASTM D1238 (230° C./2.16 kg), and (ii) 1% by weight of meltblown polypropylene having a MFR of 1800 g/10 min per ASTM D1238 (230° C./2.16 kg). The second polymeric material consisted of a blend of (i) 80% by weight of polypropylene homopolymer (i.e., PP3155E5 from Exxon) having a MFR of 36 g/10 min per ASTM D1238 (230° C./2.16 kg), (ii) 15% by weight of Dowlex Polyethylene (i.e., PE-Dowlex 2036.01G from Dow) having a MFR of 2.5 g/10 min per ASTM D1238 (230° C./2.16 kg), and (iii) 5% by weight of an EP-iPP diblock polymer (i.e., Intune™—Dow D5545) having a MFR of 9.5 g/10 min per ASTM D1238 (230° C./2.16 kg). The first polymeric material accounted for 50% by weight of the bicomponent fiber, while the second polymeric material accounted for 50% by weight of the bicomponent fiber.

For Sample 20, the first polymeric material consisted of a blend of (i) 98% by weight of a polypropylene homopolymer (i.e., PP3155E5 from Exxon) having a MFR of 36 g/10 min per ASTM D1238 (230° C./2.16 kg), and (ii) 2% by weight of meltblown polypropylene having a MFR of 1800 g/10 min per ASTM D1238 (230° C./2.16 kg). The second polymeric material consisted of a blend of (i) 80% by weight of polypropylene homopolymer (i.e., PP3155E5 from Exxon) having a MFR of 36 g/10 min per ASTM D1238 (230° C./2.16 kg), (ii) 15% by weight of Dowlex Polyethylene (i.e., PE-Dowlex 2036.01G from Dow) having a MFR of 2.5 g/10 min per ASTM D1238 (230° C./2.16 kg), and (iii) 5% by weight of an EP-iPP diblock polymer (i.e., Intune™—Dow D5545) having a MFR of 9.5 g/10 min per ASTM D1238 (230° C./2.16 kg). The first polymeric material accounted for 50% by weight of the bicomponent fiber, while the second polymeric material accounted for 50% by weight of the bicomponent fiber.

For Sample 21, the first polymeric material consisted of a blend of (i) 97% by weight of a polypropylene homopolymer (i.e., PP3155E5 from Exxon) having a MFR of 36 g/10 min per ASTM D1238 (230° C./2.16 kg), and (ii) 3% by weight of meltblown polypropylene having a MFR of 1800 g/10 min per ASTM D1238 (230° C./2.16 kg). The second polymeric material consisted of a blend of (i) 82% by weight of polypropylene homopolymer (i.e., PP3155E5 from Exxon) having a MFR of 36 g/10 min per ASTM D1238 (230° C./2.16 kg), (ii) 15% by weight of Dowlex Polyethylene (i.e., PE-Dowlex 2036.01G from Dow) having a MFR of 2.5 g/10 min per ASTM D1238 (230° C./2.16 kg), and (iii) 3% by weight of an EP-iPP diblock polymer (i.e., Intune™—Dow D5545) having a MFR of 9.5 g/10 min per ASTM D1238 (230° C./2.16 kg). The first polymeric material accounted for 50% by weight of the bicomponent fiber, while the second polymeric material accounted for 50% by weight of the bicomponent fiber.

For Sample 22, the first polymeric material consisted of 100% by weight of a polypropylene homopolymer (i.e., PP3155E5 from Exxon) having a MFR of 36 g/10 min per ASTM D1238 (230° C./2.16 kg). The second polymeric material consisted of 100% by weight of a polypropylene homopolymer (i.e., PP3155E5 from Exxon) having a MFR of 36 g/10 min per ASTM D1238 (230° C./2.16 kg). The first polymeric material accounted for 50% by weight of the bicomponent fiber, while the second polymeric material accounted for 50% by weight of the bicomponent fiber.

TABLE 1

| | Crimp Length (mm) using: 1.5" bundle length; 1" gauge length; 0.015 g fiber bundles; and 1.2"/min crosshead speed. | | |
|---|---|---|---|
| Sample # | Average | Maximum | Minimum |
| 1 | 8.7 | 14.5 | 4.9 |
| 2 | 12.3 | 18.6 | 6.3 |
| 3 | 16.6 | 27 | 9.3 |
| 4 | 11.3 | 16.8 | 7.4 |

TABLE 1-continued

| | Crimp Length (mm) using: 1.5" bundle length; 1" gauge length; 0.015 g fiber bundles; and 1.2"/min crosshead speed. | | |
|---|---|---|---|
| Sample # | Average | Maximum | Minimum |
| 5 | 16.3 | 20.8 | 11.9 |
| 6 | 12 | 14.1 | 9.3 |
| 7 | 10.1 | 17.7 | 6.9 |
| 8 | 12.2 | 17.8 | 8.7 |
| 9 | 10.9 | 18 | 5.6 |
| 10 | 23.5 | 36.7 | 11.9 |
| 11 | 23.9 | 30.8 | 15.2 |
| 12 | 18.1 | 29.3 | 8.7 |
| 13 | 24 | 33.7 | 16.5 |
| 14 | 27.1 | 37.1 | 16.2 |
| 15 | 24.6 | 30.8 | 16.5 |
| 16 | 23.8 | 31.9 | 15.2 |
| 17 | 25.7 | 32.1 | 20.1 |
| 18 | 24.5 | 34.8 | 20.5 |
| 19 | 37.6 | 59.1 | 26.5 |
| 20 | 22 | 37.3 | 10.3 |
| 21 | 21 | 30.8 | 10.5 |
| 22 | 6.2 | 7.7 | 4.7 |

TABLE 2

| Sample # | Side-1 % | Side-1 Polymers | Supplier | Polymer MFR | Polymer % | Side-2 % | Side-2 Polymers | Supplier | Polymer MFR | Polymer % |
|---|---|---|---|---|---|---|---|---|---|---|
| Sample 1 | 60 | PP3155E5 | Exxon | 36 g/10 min | 100 | 40 | PP3155E5 | Exxon | 36 g/10 min | 100 |
| Sample 2 | 60 | PP3155E5 | Exxon | 36 g/10 min | 100 | 40 | PP Copolymer SV956 | LynodellBasell | 35 g/10 min | 100 |
| Sample 3 | 60 | PP3155E5 | Exxon | 36 g/10 min | 100 | 40 | PP3155E5 | Exxon | 36 g/10 min | 80 |
| | | | | | | | PE-Dowlex 2036.01G | Dow | 2.5 g/10 min | 15 |
| | | | | | | | EP-iPP diblock polymer Intune D5545 | Dow | 9.5 g/10 min | 5 |
| Sample 4 | 60 | PP3155E5 | Exxon | 36 g/10 min | 97 | 40 | PP3155E5 | Exxon | 36 g/10 min | 80 |
| | | Metocene MF 650W | LynodellBasell | 500 g/10 min | 3 | | PE-Dowlex 2036.01G | Dow | 2.5 g/10 min | 15 |
| | | | | | | | EP-iPP diblock polymer Intune D5545 | Dow | 9.5 g/10 min | 5 |
| Sample 5 | 60 | PP3155E5 | Exxon | 36 g/10 min | 100 | 40 | PP Copolymer RP448S | LynodellBasell | 36 g/10 min | 100 |
| Sample 6 | 60 | PP3155E5 | Exxon | 36 g/10 min | 100 | 40 | PP Copolymer Pro-Fax SDS242 | LynodellBasell | 36 g/10 min | 100 |
| Sample 7 | 60 | PP3155E5 | Exxon | 36 g/10 min | 100 | 40 | PP3155E5 | Exxon | 35 g/10 min | 97 |
| | | | | | | | PE-Dowlex 2036.01G | Dow | 2.5 g/10 min | 3 |
| Sample 8 | 60 | PP3155E5 | Exxon | 36 g/10 min | 100 | 40 | PP3155E5 | Exxon | 36 g/10 min | 92 |
| | | | | | | | PE-Dowlex 2035.016 | Dow | 2.5 g/10 min | 6 |
| | | | | | | | EP-iPP diblock polymer Intune D5545 | Dow | 9.5 g/10 min | 2 |
| Sample 9 | 60 | PP3155E5 | Exxon | 36 g/10 min | 100 | 40 | PP3155E5 | Exxon | 36 g/10 min | 87 |
| | | | | | | | PE-Dowlex 2036.01G | Dow | 2.5 g/10 min | 10 |
| | | | | | | | EP-iPP diblock polymer Intune D5545 | Dow | 9.5 g/10 min | 3 |
| Sample 10 | 70 | PP3155E5 | Exxon | 36 g/10 min | 100 | 30 | PP3155E5 | Exxon | 36 g/10 min | 80 |
| | | | | | | | PE-Dowlex 2036.01G | Dow | 2.5 g/10 min | 15 |
| | | | | | | | EP-iPP diblock polymer Intune D5545 | Dow | 9.5 g/10 min | 5 |

TABLE 2-continued

| Sample # | Side-1 % | Side-1 Polymers | Supplier | Polymer MFR | Polymer % | Side-2 % | Side-2 Polymers | Supplier | Polymer MFR | Polymer % |
|---|---|---|---|---|---|---|---|---|---|---|
| Sample 11 | 50 | PP3155E5 | Exxon | 36 g/10 min | 100 | 50 | PP3155E5 | Exxon | 36 g/10 min | 80 |
| | | | | | | | PE-Dowlex 2036.01G | Dow | 2.5 g/10 min | 15 |
| | | | | | | | EP-iPP diblock polymer Intune D5545 | Dow | 9.5 g/10 min | 5 |
| Sample 12 | 30 | PP3155E5 | Exxon | 36 g/10 min | 100 | 70 | PP3155E5 | Exxon | 36 g/10 min | 80 |
| | | | | | | | PE-Dowlex 2036.01G | Dow | 2.5 g/10 min | 15 |
| | | | | | | | EP-iPP diblock polymer Intune D5545 | Dow | 9.5 g/10 min | 5 |
| Sample 13 | 7<3 | PP3155E5 | Exxon | 36 g/10 min | 97 | 30 | PP3155E5 | Exxon | 36 g/10 min | 80 |
| | | Metocene MF 650Y | LynodellBasell | 1800 g/10 min | 3 | | PE-Dowlex 2036.01G | Dow | 2.5 g/10 min | 15 |
| | | | | | | | EP-iPP diblock polymer Intune D5545 | Dow | 9.5 g/10 min | 5 |
| Sample 14 | 50 | PP3155E5 | Exxon | 36 g/10 min | 97 | 50 | PP3155E5 | Exxon | 36 g/10 min | 80 |
| | | Metocene MF 650Y | LynodellBasell | 1800 g/10 min | 3 | | PE-Dowlex 2036.01G | Dow | 2.5 g/10 min | 15 |
| | | | | | | | EP-iPP diblock polymer Intune D5545 | Dow | 9.5 g/10 min | 5 |
| Sample 15 | 30 | PP3155E5 | Exxon | 36 g/10 mm | 97 | 70 | PP3155E5 | Exxon | 36 g/10 min | 80 |
| | | Metocene MF 650Y | LynodellBasell | 1800 g/10 min | 3 | | PE-Dowlex 2036.01G | Dow | 2.5 g/10 min | 15 |
| | | | | | | | EP-iPP diblock polymer Intune D5545 | Dow | 9.5 g/10 min | 5 |
| Sample 16 | 70 | PP3155E5 | Exxon | 35 g/10 min | 100 | 30 | PP3155E5 | Exxon | 35 g/10 min | 77 |
| | | | | | | | PE-Dowlex 2035.016 | Dow | 2.5 g/10 min | 15 |
| | | | | | | | EP-iPP diblock polymer Intune D5545 | Dow | 9.5 g/10 min | 5 |
| | | | | | | | Metocene MF 6S0Y | LynodellBasell | 1800 g/10 min | 3 |
| Sample 17 | 50 | PP3155E5 | Exxon | 36 g/10 min | 100 | 50 | PP3155E5 | Exxon | 36 g/10 min | 77 |
| | | | | | | | PE-Dowlex 2036.01G | Dow | 2.5 g/10 min | 15 |
| | | | | | | | EP-iPP diblock polymer Intune D5545 | Dow | 9.5 g/10 min | 5 |
| | | | | | | | Metocene MF 650Y | LynodellBasell | 1800 g/10 min | 3 |
| Sample 18 | 30 | PP3155E5 | Exxon | 36 g/10 min | 100 | 70 | PP3155E5 | Exxon | 36 g/10 min | 77 |
| | | | | | | | PE-Dowlex 2035.016 | Dow | 2.5 g/10 min | 15 |
| | | | | | | | EP-iPP diblock polymer Intune D5545 | Dow | 9.5 g/10 min | 5 |
| | | | | | | | Metocene MF 650Y | LynodellBasell | 1800 g/10 min | 3 |
| Sample 19 | 50 | PP3155E5 | Exxon | 36 g/10 min | 99 | 50 | PP3155E5 | Exxon | 36 g/10 min | 80 |
| | | Metocene MF 650Y | LynodellBasell | 1800 g/10 min | 1 | | PE-Dowlex 2036.01G | Dow | 2.5 g/10 min | 15 |
| | | | | | | | EP-iPP diblock polymer Intune D5545 | Dow | 9.5 g/10 min | 5 |
| Sample 20 | 50 | PP3155E5 | Exxon | 36 g/10 min | 98 | 50 | PP3155E5 | Exxon | 36 g/10 min | 80 |
| | | Metocene MF 650Y | LynodellBasell | 1800 g/10 min | 2 | | PE-Dowlex 2036.01G | Dow | 2.5 g/10 min | 15 |
| | | | | | | | EP-iPP diblock polymer Intune D5545 | Dow | 9.5 g/10 min | 5 |

TABLE 2-continued

| Sample # | Side-1 % | Side-1 Polymers | Supplier | Polymer MFR | Polymer % | Side-2 % | Side-2 Polymers | Supplier | Polymer MFR | Polymer % |
|---|---|---|---|---|---|---|---|---|---|---|
| Sample 21 | 50 | PP3155E5 | Exxon | 36 g/10 min | 97 | 50 | PP3155E5 | Exxon | 36 g/10 min | 82 |
| | | Metocene MF 650Y | LynodellBasell | 1800 g/10 min | 3 | | PE-Dowlex 2036.01G | Dow | 2.5 g/10 min | 15 |
| | | | | | | | EP-iPP diblock polymer Intune D5545 | Dow | 9.5 g/10 min | 3 |
| Sample 22 | 50 | PP3155E5 | Exxon | 36 g/10 min | 100 | 50 | PP3155E5 | Exxon | 36 g/10 min | 100 |

These and other modifications and variations to the invention may be practiced by those of ordinary skill in the art without departing from the spirit and scope of the invention, which is more particularly set forth in the appended claims. In addition, it should be understood that aspects of the various embodiments may be interchanged in whole or in part. Furthermore, those of ordinary skill in the art will appreciate that the foregoing description is by way of example only, and it is not intended to limit the invention as further described in such appended claims. Therefore, the spirit and scope of the appended claims should not be limited to the exemplary description of the versions contained herein.

That which is claimed:

1. A nonwoven fabric, comprising: a plurality of crimped bicomponent fibers having a first component comprising a first polymeric material comprising a first polymer or a first polymeric blend and a second component comprising a second polymeric material; wherein the second polymeric material comprises a second polymeric blend of (i) at least one polypropylene polymer, (ii) at least one polyethylene polymer having a melt flow rate (MFR) from about 1 to about 15 g/10 min as determined by ASTM D1238 (190° C./2.16 kg), and (iii) at least one compatibilizer comprising consisting of at least one polypropylene-polyethylene copolymer.

2. The nonwoven fabric of claim 1, wherein the first polymeric material comprises a polyolefin.

3. The nonwoven fabric of claim 1, wherein the first polymeric material comprises a first polypropylene having a first melt flow rate (MFR) and a second polypropylene having a second MFR; wherein the second MFR is the same as or is larger than the first MFR.

4. The nonwoven fabric of claim 3, wherein a first MFR-ratio between the second MFR and the first MFR is from about 1:1 to about 60:1.

5. The nonwoven fabric of claim 3, wherein the first polymeric material comprises from about 70 wt. % to about 99 wt. % of a first polypropylene.

6. The nonwoven fabric of claim 5, wherein the first polymeric material comprises from about 1 wt. % to about 10 wt. % of a second polypropylene.

7. The nonwoven fabric of claim 1, wherein the second polymeric blend comprises from about 60 to about 90 wt. % of the at least one polypropylene polymer, from about 5 to about 30 wt. % of the at least one polyethylene polymer, and from about 1 to about 10 wt. % of the at least one polypropylene-polyethylene copolymer.

8. The nonwoven fabric of claim 7, wherein the at least one polypropylene polymer is a first polypropylene polymer and has a melt flow rate (MFR) of from about 10 to about 100 g/10 min as determined by ASTM D1238 (230° C./2.16 kg), the at least one polyethylene polymer is a first polyethylene polymer and has a MFR from about 1 to about 10 g/10 min as determined by ASTM D1238 (190° C./2.16 kg), and the at least one polypropylene-polyethylene copolymer is a first polypropylene-polyethylene copolymer and has a MFR of from about 0.5 to about 20 g/10 min as determined by ASTM D1238 (230° C./2.16 kg).

9. The nonwoven fabric of claim 8, wherein the first polypropylene-polyethylene copolymer is a first block copolymer.

10. The nonwoven fabric of claim 9, wherein the first block copolymer is an EP-iPP diblock polymer.

11. The nonwoven fabric of claim 9, wherein the first polypropylene-polyethylene copolymer has an ethylene monomer content from about 5 to about 60% by weight.

12. The nonwoven fabric of claim 1, wherein the plurality of crimped bicomponent fibers comprise continuous fibers, staple fibers, or a combination thereof.

13. The nonwoven fabric of claim 1, wherein the plurality of crimped bicomponent fibers comprise a side-by-side configuration, a sheath-core configuration, a pie configuration, an islands-in-the-sea configuration, a multi-lobed configuration, or any combinations thereof.

14. The nonwoven fabric of claim 1, wherein the first polymeric material comprises from about 20 wt. % to about 80 wt. % of the plurality of crimped bicomponent fibers, and wherein the second polymeric material comprises from about 80 wt. % to about 20 wt. % of the plurality of crimped bicomponent fibers.

15. The nonwoven fabric of claim 1, wherein the plurality of crimped bicomponent fibers define a first nonwoven layer, and wherein the nonwoven fabric further comprises one or more additional nonwoven layers including at least a second nonwoven layer.

16. The nonwoven fabric of claim 15, wherein the one or more additional layers comprises a spunbond layer, a meltblown layer, a carded layer, a hydroentangled layer, a cellulosic layer, or any combination thereof.

17. The nonwoven fabric of claim 16, wherein the nonwoven fabric includes one or more cellulosic layers located directly or indirectly between the first nonwoven layer and the second nonwoven layer, wherein the second nonwoven layer comprises a spunbond layer or a spunbond-meltblown-spunbond layer.

18. The nonwoven fabric of claim 1, wherein the nonwoven fabric has a basis weight from about 10 grams-per-square-meter (gsm) to about 100 gsm.

19. The nonwoven fabric of claim 1, wherein the at least one compatibilizer consists of at least one polypropylene-polyethylene copolymer.

* * * * *